US005676185A

United States Patent [19]

Starr et al.

[11] Patent Number: 5,676,185

[45] Date of Patent: Oct. 14, 1997

[54] VENTED DRUM FUNNEL

[75] Inventors: Robert J. Starr, Blair County, Pa.; Robert D. Forsythe, Jr., Richland County, Ohio

[73] Assignees: New Pig Corporation, Tipton, Pa.; Voisard Manufacturing Inc., Shiloh, Ohio

[21] Appl. No.: 645,872

[22] Filed: May 14, 1996

[51] Int. Cl.[6] ..... B65B 1/04

[52] U.S. Cl. ..... 141/300; 141/339; 141/384

[58] Field of Search ..... 141/297–300, 141/331–343, 383, 384

[56] References Cited

U.S. PATENT DOCUMENTS

| | | | |
|---|---|---|---|
| 140,350 | 7/1873 | Crowther | 141/300 |
| 951,843 | 3/1910 | Richards | 141/300 |
| 998,352 | 7/1911 | Kublin | 141/300 |
| 1,107,774 | 8/1914 | Frederick | 141/300 |
| 1,676,986 | 7/1928 | Hilford | 141/300 |
| 2,694,515 | 11/1954 | Green | 141/300 |
| 5,074,343 | 12/1991 | Tyree, Jr. | 141/300 |
| 5,101,869 | 4/1992 | Myers | 141/339 |
| 5,195,567 | 3/1993 | Tyree, Jr. | 141/331 |
| 5,402,835 | 4/1995 | Middleton | 141/339 |
| 5,445,196 | 8/1995 | Tyree, Jr. | 141/297 |

FOREIGN PATENT DOCUMENTS

| | | | |
|---|---|---|---|
| 7959 | 4/1897 | United Kingdom | 141/300 |
| 4739 | 3/1915 | United Kingdom | 141/300 |

*Primary Examiner*—Henry J. Recla
*Assistant Examiner*—Steven O. Douglas
*Attorney, Agent, or Firm*—Buchanan Ingersoll, P.C.; Michael L. Dever

[57] ABSTRACT

A vented funnel for a closed head hazardous waste container. The container is of the type having side walls and opposed upper and lower end walls. The side walls and end walls of the container border and define a cavity which opens at an opening at the upper end wall. The funnel has a housing with a passage running through the housing. A lid is movably connected to the funnel housing through open and closed positions, in which the lid is configured to create a liquid and airtight seal within the funnel housing when in the closed position. One or more vent lines having openings at opposite ends thereof are disposed within the funnel housing passage. A drum coupling is then connected to the funnel housing and is connectable to the drum. The coupling has an interior surface bordering and defining a passage, wherein the coupling passage connects to the housing passage. One or more vent passages are disposed through the coupling, in which each such vent passage is connected at one end to a vent line, and open at an opposite end along an exterior surface of the coupling.

17 Claims, 5 Drawing Sheets

VENTED DRUM FUNNEL

BACKGROUND OF THE INVENTION

1. Field of the Invention

This invention relates to funnels for drums, i.e., vertical containers, holding hazardous waste materials which are to be prevented from escaping into the environment, such as waste oils. Still more particularly, the invention relates to closed head containers having funnels which are vented and are sealable such as through the use of a hinged lid provided upon the funnel.

2. Description of the Prior Art

Drums used in the waste industry to contain and store hazardous wastes, such as waste oils, are typically 55 gallon or 30 gallon drums. Two general types of containers are common in the hazardous waste industry. These two types of containers are open head containers and closed head containers. Open head containers are containers in which the top of the container is open and a cover that is substantially the same width as the drum may be attached and detached from the top of the container.

A typical closed head container is depicted in prior art FIG. 1. Such containers 50 (also called "drums") are typically constructed of elongated side walls 52 and upper end wall 54 (a top) and lower end wall 56 (a bottom). The side walls 52 and the end walls 54, 56 border and define a container cavity 55. The closed head containers 50 have a substantially closed top 54 with a relatively small opening 58 in that top 54. Thus, the container cavity 55 opens at the small opening 58 in the upper end wall 54 of the drum 50. The drum opening 58 is threaded so that a threaded cap 60 may be threadingly engaged to the drum at the opening 58, sealing the drum 50. Waste materials are contained within container cavity 55 by being entered through container opening 58 usually through the use of some type of funnel. Such drums 50 are typically made of steel. Thus, closed head containers known in the industry are typically filled by removing the cap from the container opening, placing a funnel into the opening, placing materials into the container through the funnel, removing the funnel and placing the cap back upon the container opening. The process becomes more dangerous when dealing with hazardous materials. 40 C.F.R. § 264.173 sets forth the requirements for containers holding hazardous waste stating:

(a) a container holding hazardous waste must always be closed during storage, except when it is necessary to add or remove waste.

(b) a container holding hazardous waste must not be open, handled or stored in a manner which may rupture the container or cause it to leak.

Maintaining a seal on the drum prior to and after the filling operation is necessary because certain potentially hazardous wastes must be placed in sealed containers. For example, volatile organic compounds must often be placed in the containers. The volatile organic compounds must be prevented from exiting the container and entering the environment when stored within the container.

When the material being deposited in the drum is flammable, a risk exists that a flashback fire may occur. For this reason, it is common place in the waste disposal industry to utilize a device known generally as a fire suppresser or a flame arrester. This device, shown in prior art FIGS. 1*a* and 1*b*, is typically an elongated perforated tube usually made of some metal such as stainless steel or brass. The flame arrester typically connects to the spout of a drum funnel so that when the drum funnel is positioned to insert material into the drum, the flame arrester extends into the interior of the drum. As can be seen in FIG. 1*a*, the fire suppresser device typically has external threading 11 provided at one end in which the fire arrester may be threadably engaged at that end to a drum funnel spout.

U.S. Pat. No. 5,402,835 to Middleton discloses a sealable drum funnel which is attached onto a drum. The Middleton patent utilizes a T-type plug member which threadably engages to a drum coupling to seal the passage into the container. The Middleton patent also discloses a hinged sealable lid for the drum funnel. The patent of Middleton does not, however, disclose venting means with the drum funnel.

The containment and removal of liquids contained within a drum have proven to be somewhat burdensome and messy. Unfortunately, often during the filling of a hazardous waste container, displaced air travels back up through the funnel housing in a condition known as "burping". During burping, the displaced air may cause hazardous waste material to be splashed or otherwise to leak exterior to the drum funnel and the container.

Therefore, it would be advantageous in the hazardous waste storage industry to provide a drum funnel for a closed head container which can be coupled to the drum and sealed while attached to the drum. It would further be advantageous for such a funnel to have venting means such that venting of displaced container air is accomplished during the filling process but that a complete seal is provided at times other than during the filling process.

SUMMARY OF THE INVENTION

A vented funnel for a closed head hazardous waste container is provided which is vented. The vented funnel of the present invention is sealed to the waste container easily such as by threaded engagement thereto, but also has a lid portion which may be opened and closed so that materials may be added to the drum without the funnel being attached to and removed from the drum each time materials are added to the drum. The funnel of the present invention further includes a venting path which allows waste materials to be added to the drum in a way that avoids "burping". The present drum funnel further does not allow material stored in the container to exit the container through the venting path or otherwise when the lid of the funnel is closed.

The closed head container with which the cover of the invention is used is of the type that is constructed of elongated side walls and opposed upper and lower end walls which border and define a container cavity. The container has a relatively small opening provided through the upper end wall, through which the cavity is accessible. The open head container is further of the type in which a cover or cap is secured upon the container body opening to seal the container.

The funnel of the present invention has a funnel housing, in which a passage is provided through the funnel housing. The passage opens at a first end of the housing and narrows to an opening at a second end of the funnel housing. The funnel housing also has a drum coupling connected to the funnel housing second end that is sealably engageable to the upper end wall of the container such that the housing passage is connected to the container cavity. The drum coupling may be integral with the funnel housing or may be a separate compartment which may be attached to the funnel housing. Although the drums with which the funnel is used are typically cylindrical, thus having a circular cross section, the funnel may be used with drums having any cross sectional shape.

A hinge is then provided upon the funnel housing, and a lid is movably connected to the hinge. The lid is sealable with the funnel housing first end and a gasket is preferably provided between the lid and the funnel housing first end, around the housing first end opening. The lid is movable about the hinge through open and closed positions relative to the funnel housing first end. When the lid is in the open position, the funnel housing first end opening is uncovered. When the lid is in the closed position, the lid is in sealed engagement with the funnel housing first end.

A lock is used to secure the lid into air-tight engagement with the funnel housing first end. The lock is preferably one or more clamps provided around the lid at the funnel housing first end. The sealing portion of the funnel housing is preferably a threaded annulus which threadably engages with the upper end walls of the container at the container opening. A gasket is then provided around the sealing portion upon a ledge so as to be positioned between the ledge and the upper end wall of the container around the container opening.

The funnel has venting means provided therewith. The venting means preferably includes one or more vent passages disposed through the coupling in which one end of each vent passage opens at an exterior surface of the coupling. An opposite end of each vent passage connects to a respective elongated vent line disposed within the funnel housing passage.

Other objects and advantages of the invention will become apparent from a description of certain present preferred embodiments thereof shown in the drawings.

DETAILED DESCRIPTION OF THE PREFERRED EMBODIMENTS

Figure 2:
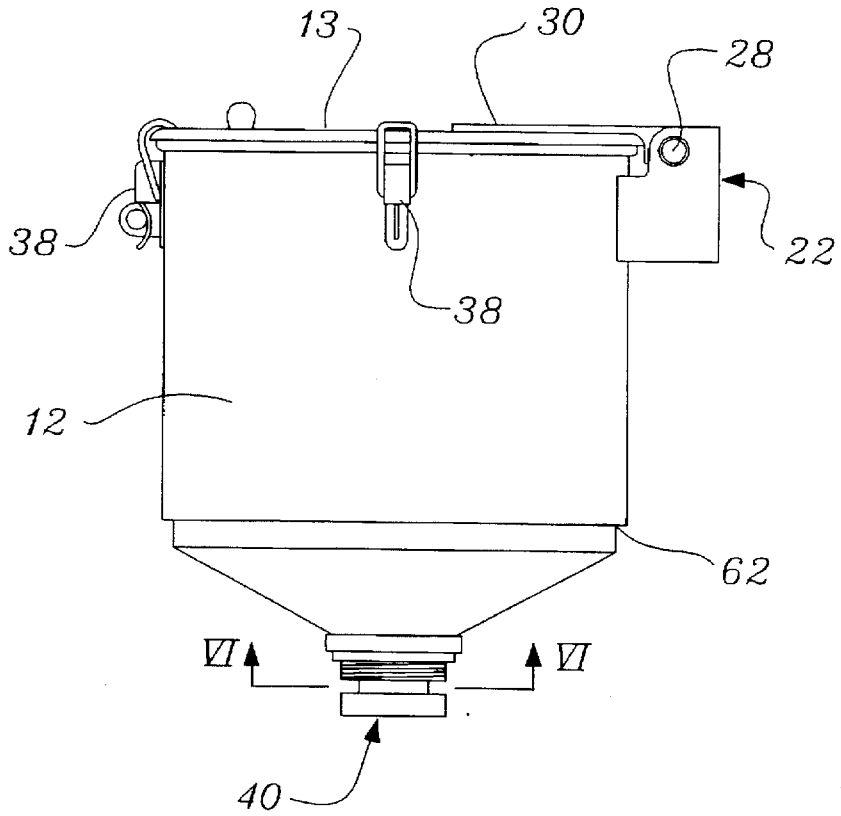
FIG. 2 is a side elevational view of the preferred vented drum funnel.
Figure 3:
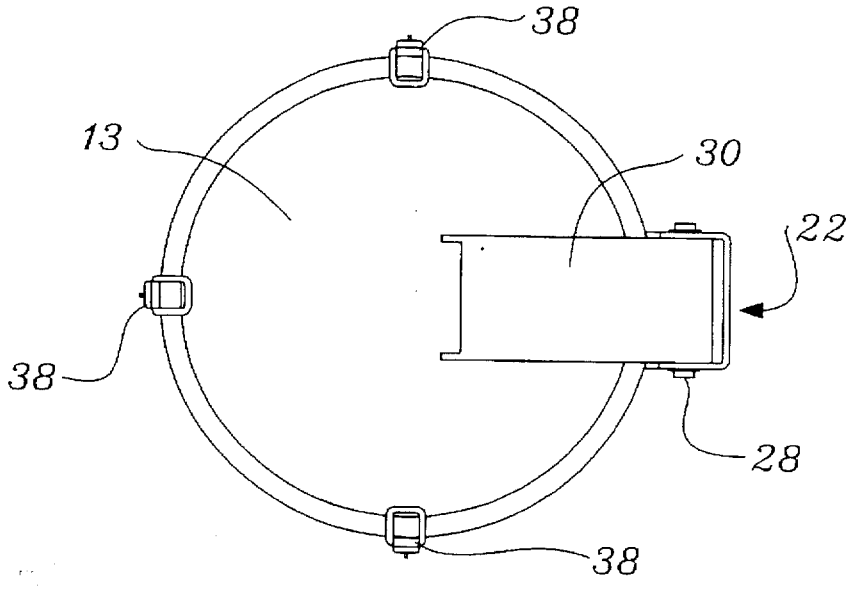
FIG. 3 is a top plan view of the preferred vented drum funnel.

Referring first to FIGS. 2 and 3, a funnel 10 is shown for a closed head hazardous waste container 50 (the waste container is not shown in FIGS. 2 and 3). The funnel 10 of the present invention replaces the caps and funnels previously used in the industry. The funnel 10 of the present invention has as its main components a funnel housing 12 and a lid 13. The main components of the funnel 10 cooperate such that the funnel housing 12 is sealable to the container and the lid 13 is movably connected to the funnel housing. Both the funnel housing 12 and the lid 13 are preferably fabricated of steel.

Figure 4:
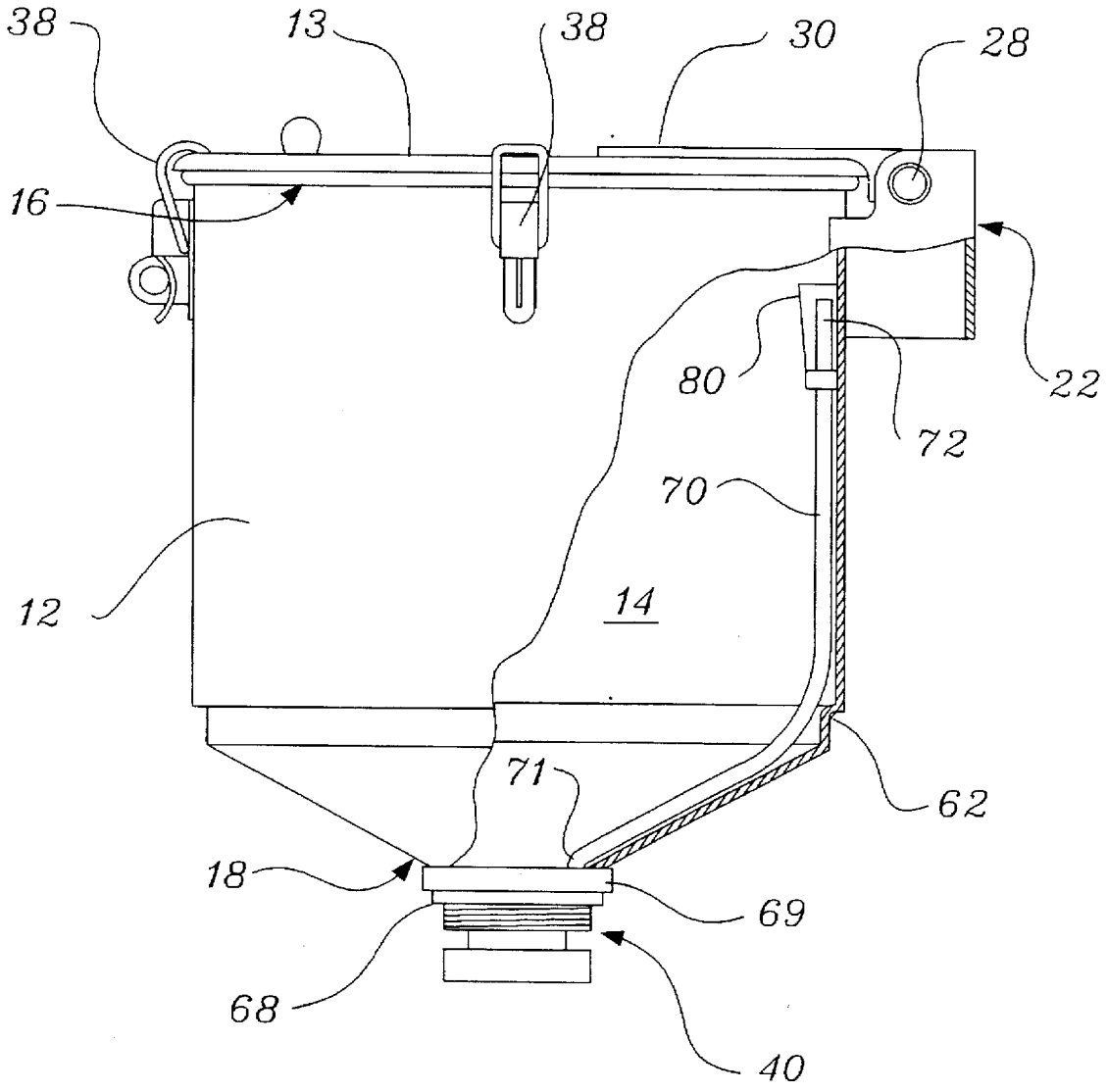
FIG. 4 is a side elevational view, partially broken away, of the preferred vented drum funnel with the lid closed.

Referring next to FIG. 4, the funnel housing 12 of the funnel 10 is hollow so that a passage 14 is provided through the funnel housing 12. The passage 14 through funnel housing 12 opens at opposed ends of the funnel housing 12, so as to open at a first (i.e., upper) end 16 and a second (i.e., lower) end 18 of the funnel housing 12. As with typical funnels, the funnel housing passage 14 narrows so that the housing passage 14 is wider at the first end 16 of the funnel housing 12 and is more narrow at the second end 18 of the funnel housing 12. The funnel housing 12 connects to the container 50, preferably through a coupling portion 40 that is provided at the second end 18 of the funnel housing 12. The coupling portion 40 sealably engages the funnel housing 12 to the drum 50, as described in greater detail below.

Figure 1:
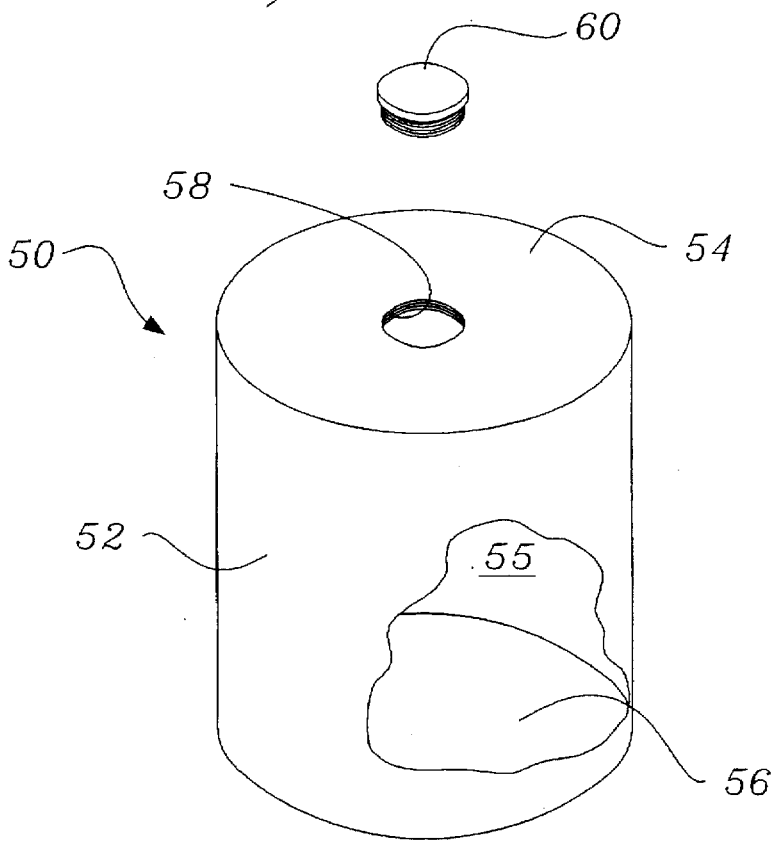
Fig.1. (Prior Art)
FIG. 1 is a perspective view of a prior art closed head container, partially broken away.
Figure 1A:
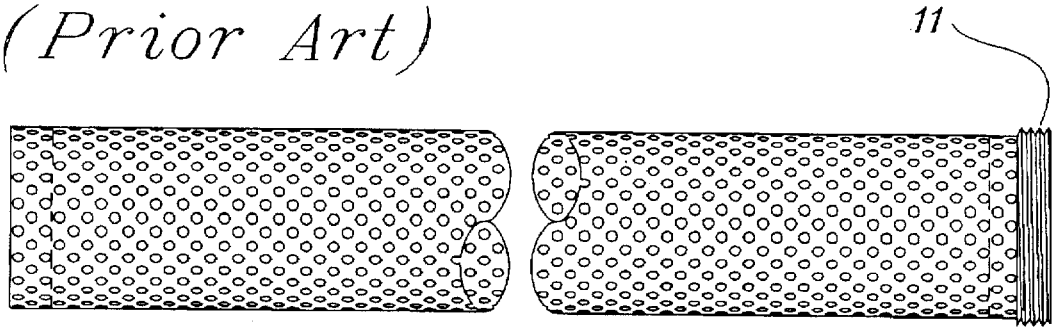
Fig.1a. (Prior Art)
FIG. 1*a* is a side view of a prior art fire suppresser, broken away.
Figure 1B:
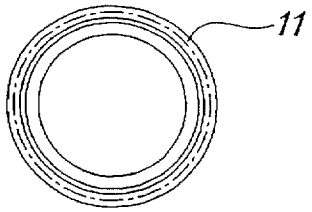
Fig.1b. (Prior Art)
FIG. 1*b* is a front view of a prior art fire suppresser.

The closed head container 50, with which the funnel 10 of the invention is used is of the type commonly used in the industry. Such a closed head container 50 is shown in prior art FIG. 1 and has been described herein. In general, the upper end wall 54 of the container 50 has a relatively small opening 58 disposed therethrough. The opening 58 is typically threaded and heretofore, when no materials are to be entered into or removed from the container 50, a cap 60 is removed from the drum 50 at the opening 58. When the container 50 is to be sealed, the cap 60 was threadably engaged to the drum 50 and the drum opening 58.

Figure 5:
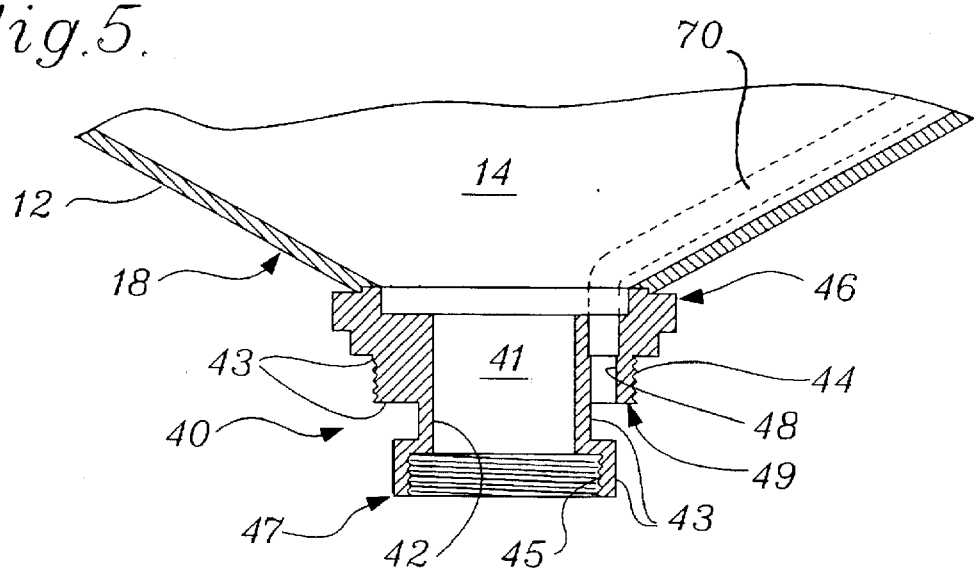
FIG. 5 is a cross sectional view of a portion of the preferred vented drum funnel showing the funnel coupling.

Referring next to FIG. 5, the coupling 40 sealably engages the funnel housing 12 to the drum 50. The coupling 40 may be integral with the funnel housing 12 or may be fabricated as a separate part or combination of parts that are attached to the funnel housing 12. The coupling 40 may be affixed to the funnel housing 12 by any convenient means, such as, for example, by being welded to the sealed end 18 of the funnel housing 12. The coupling 40 of the funnel housing 12 is preferably made of steel.

The coupling 40 has a passageway 41 disposed therethrough. The coupling passageway 41 is bordered and defined by an interior surface 42 of the coupling 40. The coupling 40 further has an exterior surface 43. The coupling passageway 41 opens at a first end 46 and at a second end 47 of the coupling 40. As described above, the coupling 40 is affixed to the funnel housing 12, preferably by the first end 46 of the coupling 40 being affixed to the second end 18 of the funnel housing 12. In this way, the funnel housing passage 14 is connected to the coupling passageway 41. Thus, materials which have entered the first end 16 of the funnel housing 12 will travel through the funnel housing passage 14 and through the coupling passageway 41 out of the coupling 40.

The coupling 40 is preferably provided with means for connecting the funnel housing 12 to a container 50 (container 50 is not shown in FIG. 5). For this purpose, external threading 44 is provided along the exterior surface 43 of the coupling 40. Although external threading 44 is the preferred means of connecting the funnel 10 to the container 50, any convenient means may be used. Threading provided along the coupling 40 is the preferred manner of connecting the funnel to the container because containers are typically equipped with threaded openings.

The coupling 40 is also preferably provided with internal threading 45 which is provided along the interior surface 42 of the coupling 40. The internal threading 45 is provided so that a fire suppresser (not shown in FIG. 5) may be threadably engaged to the coupling 40 at the internal threading 45.

Figure 6:
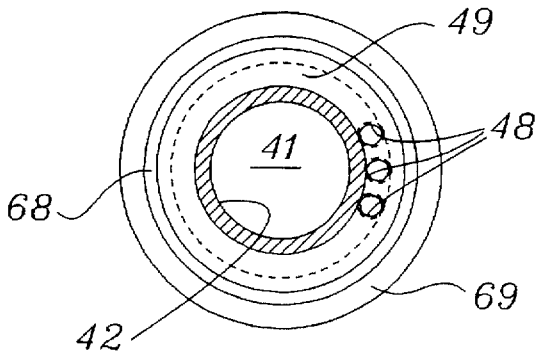
FIG. 6 is a view taken along line VI—VI of FIG. 2.

Referring to FIGS. 5 and 6, the coupling 40 further has one or more, and preferably three, vent passages 48 disposed therethrough. The vent passages 48 are preferably provided between at least some portion of the interior surface 42 and the exterior surface 43 of the coupling 40 so that the vent passage 48 does not connect with the coupling passageway 41. The elongated vent passages open at one end at the coupling first end 46. The vent passages 48 also open at an opposite end exterior to the coupling passageway 41 along the coupling exterior surface 43. As can be seen in FIG. 5, the coupling exterior surface 43 is essentially any coupling surface other than the interior surface 42. Preferably, a portion of the coupling exterior surface 43 is configured as an annular ledge 49 (also shown in FIG. 6). Thus, vent passages 48 preferably open at one end along the annular ledge 49 and at opposite ends along the first end 46 of the coupling 40. In this way, it can be seen that materials which have entered the funnel housing 12 will travel through the funnel housing passage 14, through the coupling passageway 41, out through the coupling second end 47 and into the storage container 50. Simultaneous to this, displaced air from within the storage container 50 will enter the vent passages 48 along the annular ledge 49 of the coupling 40 and will travel out of the vent passages 48 at the coupling first end 46, without intermingling with or traveling through the coupling passageway 41.

Referring next to FIGS. 4 and 5, elongated vent lines 70 (shown in dotted line in FIG. 5 for clarity) then connect with each vent passage 48. Each of the vent lines 70 connect to a respective vent passage 48 at the first end 46 of the coupling 40 and then extend upward in the housing cavity 14, preferably toward the first end 16 of the funnel housing 12. Vent links 70 have a first end 71 which connects to the vent passages 48 and have a second end 72 which extend toward the funnel housing first end 16. In this way, the hollow vent lines 70 form a continuous pathway with the vent passages 48 in which the displaced air which enters the coupling passages 48 will travel upward through the vent lines 70 toward the first end 16 of the funnel housing.

When the funnel 10 is connected to a container 50, the second end 47 of the coupling 40 is inserted partially within the container 50 so that the external threading 44 may engage the threaded drum opening 58. A gasket 68 is preferably provided along the external surface 43 of the coupling 40. A sealing ledge 69 is further provided along the first end 46 of the coupling. Thus, as the coupling 40 is moved into close engagement with the container opening 50, such as by being fully down into the container opening 58, the sealing ledge 69 and the upper end wall 54 around the container opening 58 move towards one another compressing the gasket 68 therebetween. Thus, an air tight and water tight seal is formed between the funnel 10 and the storage container 50.

Figure 7:
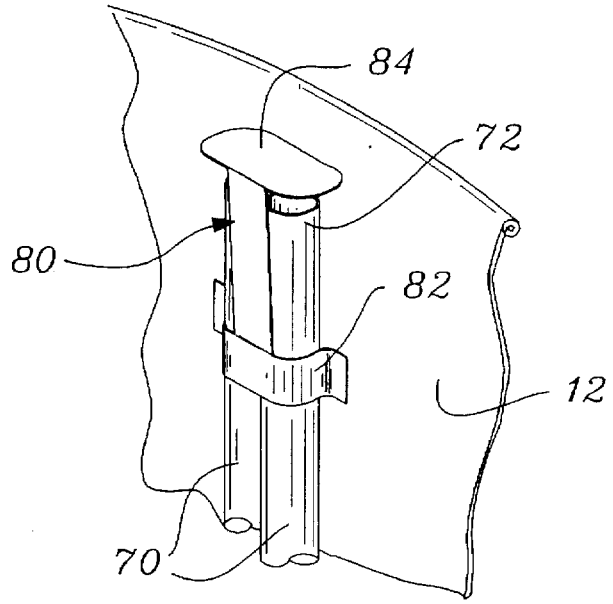
FIG. 7 is a view of a view of a portion of the preferred vented drum funnel showing the vent hood.

Referring to FIGS. 4 and 7, a hood 80 is preferably disposed over the vent line second ends 72. The hood 80 is sized and configured so that materials which are entered into the funnel housing 12 at the funnel housing first end 16 may not enter the vent lines 70. As can be seen best in FIG. 7, the hood 80 may be connected to the interior surface of the funnel housing by any convenient means. Preferably, the hood 80 has tangs 82 which are affixed to the funnel housing 12, such as by being welded thereto. It is further preferred that a hood shield portion 84 be provided over the vent line second ends 72 to provide the impediment to materials, preventing them from entering the vent lines 70. It is preferred that the shield portion 84 of the hood 80 also be affixed to the funnel housing 12 by any convenient means such as by being welded thereto.

Thus, the funnel 10 of the present invention is sealed to the waste container 50 easily through standard means (i.e., through threaded engagement with the opening of the drum 50), requiring no modifications to the existing containers 50. However, the funnel 10 of the present invention also has a lid 13 which may be opened and closed so that the drum 50 may be sealed after materials have been added to the drum 50, without the funnel 10 being removed from the drum 50. Therefore, the present drum funnel 10 allows waste materials to be incrementally added, to the drum 50 quickly and easily and without having to unsecure and resecure the funnel 10 to the drum 50 each time materials are added to the drum 50.

Figure 8:
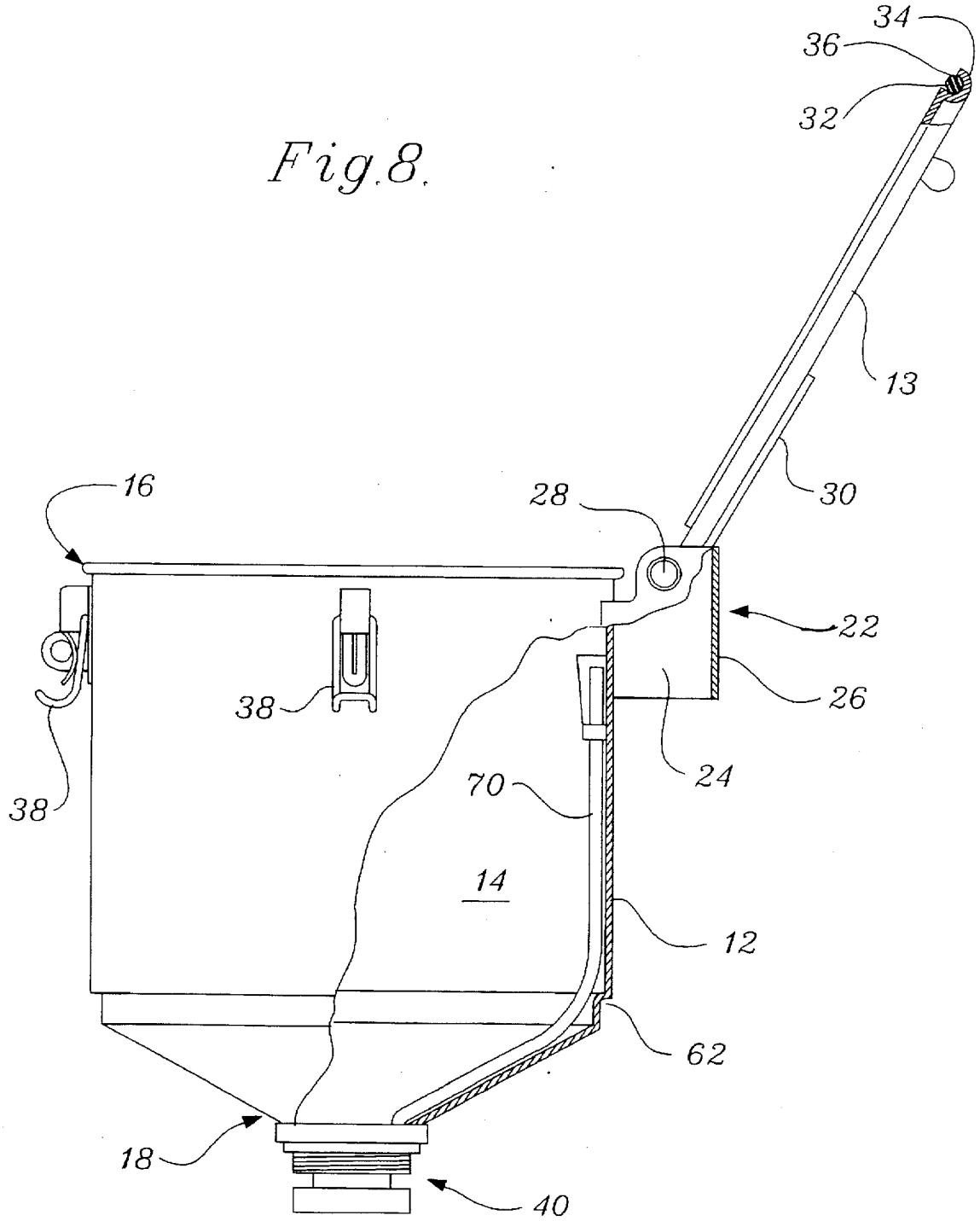
FIG. 8 is a side elevational view, partially broken away, of the preferred vented drum funnel with the lid open.

Referring next to FIGS. 4 and 8, the operation of the lid 13 will now be described. The lid 13 preferably has an annular lip 34 provided around its outer periphery. The annular lip 34 preferably has a curved seat 36. A gasket 32 is then provided upon the curved seat 36. Preferably, gasket 32 is affixed to the curved seat 36 of the annular lip 34 such as through the use of an adhesive. The materials from which both the gasket 32 and the adhesive (not shown) are fabricated are selected so as to be compatible with the particular materials stored in drum 50 (i.e., to not deteriorate when in contact with such materials). Preferably, gasket 32 is annular and is continuous. The gasket 32 is further preferably made of a resilient material.

As will be described in greater detail below, a hinge 22 movably connects the lid 13 to the funnel housing 12. The lid 13 is movable about the hinge 22 through open and closed positions relative to the funnel housing 12. When the lid 13 is moved away from contact with the funnel housing 12, the lid is said to be in an open position as shown in FIG. 8. When the lid 13 is in such an open position, drum cavity 55 is accessible by way of housing cavity 14.

When the lid 13 is moved about hinge 22 toward the funnel housing 12, lid 13 is said to be in a closed position as shown in FIG. 4. When the lid 13 is in the closed position, the lid 13 is in sealed engagement with the funnel housing 12 so that the housing passage 14 is inaccessible. When lid 13 is moved into the closed position, gasket 32 is compressed between the curved seat 36 of the annular lip 34 and the first end 16 of the funnel housing 12. The first end 16 of the funnel housing 12 is preferably rounded. The housing first end 16 may be rounded by any convenient means such as by rolling over the end of the funnel housing 12. When the gasket 32 is held between the curved seat 36 and the rounded first end 16 of the funnel housing 12, gasket 32 will compress. The gasket 32 being compressed between the curved seat 36 of the annular lip 34 and the rounded first end 16 of the funnel housing 12 creates an air tight and water tight seal between the lid 13 and the funnel housing 12.

Referring again to FIGS. 1, 2, 3 and 4, the hinge 22 will now be described. The hinge 22 operatively connects the lid 13 to the funnel housing 12, so that the lid 13 is movably connected to the funnel housing 12. The hinge 22 may be constructed in any convenient fashion to allow relative movement between the lid 13 and the funnel housing 12. The components of the hinge 22 are preferably fabricated of steel. The hinge 22 preferably has a lid portion 30 which is connected to the lid 13. The lid portion 30 of the hinge 22 may be connected to the lid 13 by any convenient means, such as by being welded to the lid 13 or by being integral with the lid 13. The hinge 22 further preferably has a housing portion 24 which is affixed to the funnel housing 12. The hinge housing portion 24 may also be connected to the funnel housing 12 by any convenient means, such as by being welded to the funnel housing 12 or by being integral with the funnel housing 12.

The housing portion 24 of the hinge 22 further preferably has a rear wall 26. A hinge pin 28 is then disposed through the hinge housing portion 24 and the hinge lid portion 30 so that the housing portion 24 and lid portion 30 of the hinge 22 may rotate about hinge pin 28 relative to one another. The hinge 22 is preferably sized and configured such that when the lid 13 is pivoted about the hinge 22 into the open position, as shown in FIG. 4, the lid portion 30 of the hinge 22 will eventually contact the rear wall 26 of the hinge housing portion 24. When the lid portion 30 of the hinge 22 contacts the rear wall 26 of the housing portion 24, the lid portion 30 of the hinge 22 and thus the lid 13 to which the lid portion 30 is affixed will be prevented from further rotating about the hinge pin 28.

The lid 13 and the hinge 22 are preferably sized and configured so that the curved seat 36 of the annular lip 34 is separated a selected distance from the first end 16 of the funnel housing 12. This selected distance is chosen to be less than the thickness of the gasket 32. In this way, when the lid 13 is moved about the hinge 22 into the closed position, the gasket 32 is compressed between the curved seat 36 of the annular lip 34 and the first end 16 of the funnel housing 12.

Referring again to FIG. 1, a means for locking the lid 13 into air-tight engagement with the funnel housing 12 is also provided. The locking means is preferably one or more clamps 38 which are affixed to the funnel housing 12 and which are provided circumferentially around the housing first end 16. The clamps 38 are sized and configured to grasp the lid 13 along the annular lip 34 of the lid 13. The clamps 38, when engaged as shown in FIG. 4, hold the lid 13 such that gasket 32 is compressed between the curved seat 36 of the annular lip 34 and the curved first end 16 of the housing 12. The clamps 38 thus retain the lid 13 sealably in the closed position. When the clamps 38 are released, as shown in FIG. 8, the lid 13 may be opened. Although any number of clamps 38 may be used, three clamps 38 are preferred.

Provided along the funnel housing 12 preferably at the second end 18 of the funnel housing 12 is an annular ledge 62. The ledge 62 is sized and configured such that a mesh screen (not shown) may be placed upon the ledge 62 and be supported thereupon. The ledge 62 is further configured and located so that the mesh screen is provided within the funnel housing 12 when supported upon the ledge 62. The mesh screen may thus act as a filter for the materials being entered into the drum 50 through the cover 10. The mesh screen is preferably fabricated from a strong, durable material, such as steel. When such a mesh screen is used, it should be cut out or otherwise configured so that the vent lines 70 may travel along the interior of the funnel housing.

Variations of the preferred embodiment may be made. For example, although the drums 50 with which the funnel is used are typically cylindrical, thus having a circular cross section, the funnel 10 may be used with the drums 50 having any cross sectional shape. Further, although the funnel housing 12, the lid 13, the hinge 22 and the mesh screen are preferably fabricated of steel, any suitable material may be used.

While certain present preferred embodiments have been shown and described, it is distinctly understood that the invention is not limited thereto but may be otherwise embodied within the scope of the following claims.

We claim:

1. A funnel for a closed head hazardous waste container, wherein the container is of the type having elongated side walls which terminate in end walls at first and second ends thereof, such that the side walls and end walls border and define a container cavity which opens at a container opening at the second end wall; the funnel comprising:

(a) a funnel housing having a passage therethrough, in which the housing passage has an opening at a first end of the housing and an opening at a second end of the housing;

(b) a lid connected to the funnel housing for movement between open and closed positions, wherein the lid is configured to create a liquid and airtight seal within the funnel housing when in the closed position;

(c) at least one elongated vent line, wherein each at least one vent line has openings at a first end and a second end thereof, and, wherein the vent line first end is disposed within the funnel housing passage; and (d) a drum coupling that is connected to the funnel housing second end and is connectable to the drum, the coupling having:

(i) an exterior surface, wherein at least a portion of the coupling exterior surface is disposed within the container cavity when the coupling is connected to the container;

(ii) an interior surface bordering and defining a passage, wherein the coupling passage connects to the housing passage; and (iii) at least one vent passage formed through the coupling, wherein a first end of each such vent passage is connected to a second end of the at least one vent line, and a second end of each such vent passage opens at the exterior surface of the coupling and within the container cavity when the coupling is connected to the container.

2. The funnel of claim 1 wherein the drum coupling exterior surface has a threaded portion for threaded engagement with the container opening.

3. The funnel of claim 1 wherein the drum coupling interior surface has a threaded portion for threaded engagement with a fire suppresser.

4. The funnel of claim 1 wherein the lid is lockable into the closed position with the funnel housing by means of at least one clamp affixed to the funnel housing.

5. The funnel of claim 4 wherein the lid has an annular lip provided around an outer periphery of the lid and wherein the at least one clamp is sized and configured to grasp the lid along the annular lip.

6. The funnel of claim 1 wherein the lid is movably connected to the funnel housing by means of a hinge, wherein the hinge has a lid portion connected to the lid, a housing portion connected to the housing and a hinge pin disposed through the hinge housing portion and the hinge lid portion so that the housing portion and the lid portion may rotate about the hinge pin relative to one another.

7. The funnel of claim 6 wherein the housing portion of the hinge has a rear wall, and wherein the hinge is sized and configured such that when the lid is pivoted about the hinge away from the housing, the lid portion of the hinge will contact the rear wall of the hinge housing portion such that the lid portion of the hinge will be prevented from further rotating about the hinge pin.

8. The funnel of claim 1 further comprising a hood disposed within the housing cavity and above the vent line first end.

9. The funnel of claim 1 wherein the coupling exterior surface has an annular ledge, and wherein the second end of the at least one coupling vent passage opens along the annular ledge.

10. The sealable vented drum funnel of claim 1 wherein the drum coupling interior surface has a threaded portion.

11. The funnel of claim 1 wherein the coupling exterior surface has an annular ledge, and wherein the second end of the at least one coupling vent passage opens along the annular ledge.

12. A sealable, vented drum funnel comprising:

a funnel housing having a passage therethrough, in which the housing passage has an opening at a first end of the housing and an opening at a second end of the housing;

a lid connected to the funnel housing for movement between open and closed positions, wherein the lid is configured to create a liquid and air tight seal within the funnel housing when in the closed position;

at least one elongated vent line, wherein each at least one vent line has openings at a first end and a second end thereof, and wherein the vent line first end is disposed within the funnel housing passage; and a drum coupling connected to the funnel housing second end, said drum coupling having:

an exterior surface;

an interior surface bordering and defining a passage, wherein the coupling passage connects to the housing passage; and at least one vent passage formed through the coupling, wherein a first end of each such vent passage is connected to a second end of the at least one vent line, and a second end of each such vent passage opens at the exterior surface of the coupling.

13. The sealable vented drum funnel of claim 12 wherein the drum coupling exterior surface has a threaded portion.

14. The funnel of claim 12 wherein the lid is lockable into the closed position with the funnel housing by means of at least one clamp affixed to the funnel housing.

15. The funnel of claim 14 wherein the lid has an annular lip provided around an outer periphery of the lid and wherein the at least one clamp is sized and configured to grasp the lid along the annular lip.

16. The funnel of claim 12 wherein the lid is movably connected to the funnel housing by means of a hinge, wherein the hinge has a lid portion connected to the lid, a housing portion connected to the housing and a hinge pin disposed through the hinge housing portion and the hinge lid portion so that the housing portion and the lid portion may rotate about the hinge pin relative to one another.

17. The funnel of claim 16 wherein the housing portion of the hinge has a rear wall, and wherein the hinge is sized and configured such that when the lid is pivoted about the hinge away from the housing, the lid portion of the hinge will contact the rear wall of the hinge housing portion such that the lid portion of the hinge will be prevented from further rotating about the hinge pin.

* * * * *